US005233396A

United States Patent [19]

Simms et al.

[11] Patent Number: 5,233,396

[45] Date of Patent: Aug. 3, 1993

[54] INTERMEDIATE TRANSFER MEMBER HAVING A LOW SURFACE ENERGY COMPLIANT STRUCTURE AND METHOD OF USING SAME

[75] Inventors: Robert Simms, Dayton, Ohio; Tab Tress, Rochester, N.Y.; Dana Smith, Anaheim, Calif.; Anders J. Wellings, Newark, Del.

[73] Assignee: Xerox Corporation, Stamford, Conn.

[21] Appl. No.: 803,821

[22] Filed: Dec. 9, 1991

[51] Int. Cl.[5] ..... G03G 15/16

[52] U.S. Cl. ..... 355/275; 355/274

[58] Field of Search ..... 355/274, 275, 271, 281, 355/273, 210, 211, 212

[56] References Cited

U.S. PATENT DOCUMENTS

| | | | |
|---|---|---|---|
| 3,893,761 | 7/1985 | Buchan et al. | 355/275 |
| 3,923,392 | 12/1975 | Buchan et al. | 355/275 X |
| 3,947,113 | 3/1976 | Buchan et al. | 355/275 X |
| 4,430,412 | 2/1984 | Miwa et al. | 430/126 |
| 4,708,460 | 11/1987 | Langdon | 355/274 |
| 4,796,048 | 1/1989 | Bean | 355/275 X |
| 4,984,025 | 1/1991 | Landa et al. | 355/274 |
| 5,028,964 | 7/1991 | Landa et al. | 355/273 |
| 5,040,028 | 8/1991 | Kamimura et al. | 355/275 |
| 5,132,743 | 7/1992 | Bujese et al. | 355/274 |

FOREIGN PATENT DOCUMENTS

| | | |
|---|---|---|
| 0164368 | 12/1981 | Japan . |
| 0063972 | 3/1987 | Japan . |
| 0034571 | 2/1988 | Japan . |

*Primary Examiner*—A. T. Grimley
*Assistant Examiner*—J. Barlow
*Attorney, Agent, or Firm*—Oliff & Berridge

[57] ABSTRACT

A toner image is transferred from an electrostatographic imaging member to an image receiving substrate. A biased transfer member in the form of a roller or a belt forms a nip with the imaging member. A compliant intermediate transport member passes through the nip for receiving a toner image from the imaging member. The intermediate transport member is preferably semiconductive, and self-discharges in less than one second. In a preferred process for transferring the toner image to a conductive conformable intermediate, both the intermediate transport member and the biased transfer roller are conductive.

33 Claims, 3 Drawing Sheets

INTERMEDIATE TRANSFER MEMBER HAVING A LOW SURFACE ENERGY COMPLIANT STRUCTURE AND METHOD OF USING SAME

FIELD OF THE INVENTION

This invention relates to a device and method for transferring a toner image from an electrostatographic imaging member to an image receiving substrate via an intermediate member.

BACKGROUND

A typical electrostatographic printing machine (such as a photocopier, laser printer, facsimile machine or the like) employs an imaging member that is exposed to an image to be printed. Exposure of the imaging member to the image to be printed records an electrostatic latent image on the imaging member corresponding to the informational areas contained within the image to be printed. Generally, the electrostatic latent image is developed by bringing a toner or developer mixture into contact therewith.

Two types of developer materials, liquid and dry, are typically employed in electrostatographic printing machines. A dry developer mixture usually comprises carrier granules having toner particles adhering triboelectrically thereto. Toner particles are attracted from the carrier granules to the latent image, forming a toner powder image thereon. Alternatively, a liquid developer material includes a liquid carrier having toner particles dispersed therein. The developer material is advanced into contact with the electrostatic latent image and the toner particles are deposited thereon in image configuration.

The developed image recorded on the photoconductive member is transferred to a support material such as paper either directly or via an intermediate transport member. The intermediate transport member may be in the form of a continuous belt or a roller. The toner image particles may be physically transferred by means of pressure or heat to the intermediate transport member, or they may be electrostatically transferred to the intermediate transport member by means of an electrical potential between the imaging member and the intermediate transport member. After the toner image has been transferred to the intermediate transport member, it is then transferred to the support material.

In electrostatographic printing machines in which the toner image is electrostatically transferred by a potential between the imaging member and the intermediate transport member, it is critical that the transfer of the toner particles to the intermediate transport member and the retention thereof be as complete as possible and that the image ultimately transferred to the support material have a high resolution.

U.S. Pat. No. 5,028,964 (Landa et al.) discloses an intermediate transport member in a system which uses heat and pressure to transfer an image to a substrate. The intermediate transport member may be a belt which is comprised of an arrangement of electrical conductors, wherein an angularly delimited portion of the intermediate transport member is energized. The energized portion is selected so as to roughly correspond with a region of a nip between the intermediate transport member and a photoconductor surface. The energized portion corresponds to the region filled with liquid, which is delineated by adjacent radii, thus reducing or eliminating electrical discharge. The intermediate transport member is comprised of a high tensile substrate, a resilient layer, a resistive heating layer containing a nickel-chrome alloy, and an insulative layer containing polyurethane. The electrical conductors are supported on the insulative layer. There is no discussion of a compliant or self-discharging conductive or semiconductive outer layer comprising the intermediate transport member. Consequently, there could be a charge buildup on the insulative layer.

U.S. Pat. No. 4,984,025 (Landa et al.) discloses an intermediate transport member similar to that of U.S. Pat. No. 5,028,964 but with parallel arrays of uniformly spaced, energizable, electrical conductors supported on the insulative layer and embedded in a layer of conductive material such as a silicon-polyurethane copolymer. The parallel array permits the heating of the intermediate transport member to be spatially selective to enhance the cohesiveness of an image to be transferred from the intermediate transfer member to a substrate such as paper. As in U.S. Pat. No. 5,028,964, a charge buildup can result on the insulative layer.

U.S. Pat. No. 4,796,048 (Bean) discloses an apparatus which transfers a plurality of liquid images from a photoconductive member to a copy sheet. The apparatus may include an intermediate transport belt to transfer a toner image to a copy sheet with the use of a biased transfer roller. The intermediate transport belt has a smooth surface, is non-absorbent, and has a low surface energy.

U.S. Pat. No. 4,708,460 (Langdon) discloses an apparatus for transferring a liquid image from a photoconductive member to an intermediate transport member. The photoconductive surface is preferably made from a selenium alloy with a conductive substrate made from an aluminum alloy which is electrically grounded. A voltage source is coupled to a roller so as to electrically bias the roller with a suitable potential and polarity. This electrical bias, in turn, electrically biases the intermediate transport belt. The intermediate transport belt is positioned to contact a photoreceptor belt in a nip. Preferably, the intermediate transport belt is made from a somewhat electrically conductive silicone material having an electrical conductivity of about $10^9$ ohm-centimeters. Consequently, the belt is semiconductive. There is no indication that the belt is compliant, nor is there any indication of the belt comprising a dimensionally stable substrate.

U.S. Pat. No. 4,430,412 (Miwa et al.) discloses a method and apparatus for transferring and fixing a toner image, wherein a toner image is transferred and fixed onto a transfer material by an intermediate transfer member. The intermediate member may be a belt-type member which is pressed onto an outer periphery of a toner image retainer with a pressure roller. The intermediate member is suspended on a heat roller and a tension roller beside the pressure roller. The intermediate member is formed with a laminate of a transfer layer comprising a heat resistant elastic body such as silicone rubber or fluororubber, and a heat resistant base material such as stainless steel.

U.S. Pat. No. 3,893,761 (Buchan et al.) discloses a xerographic heat and pressure transfer and fusing apparatus having an intermediate transfer member which has a smooth surface, a surface free energy below 40 dynes per centimeter and a hardness from 30 to 70 durometer Shore Å. The transfer member, preferably in the form of a belt, can be formed, for example, from a polyamide film substrate coated with 0.1–10 millimeters of silicone rubber or a fluoroelastomer.

In multicolor copying systems in which the toner image on the imaging member is transferred across an electrical potential to the intermediate transport member, the toner on the intermediate transport member has a tendency to change its charge sign, thereby neutralizing the electrical potential between the imaging member and the intermediate transport member.

Toner, which generally has a negative charge, is positioned on the imaging member after development in a multicolor photocopier. A charged biased transfer roller charges the back side of the intermediate transport member. Alternatively, a corona supplies a charge, normally positive, to the back side of an intermediate transport member. The positive charge on the back side of the intermediate transport member breaks down the air between the image receptor and the transport member and both the negative charges of the air and of the toner particles are attracted to the front side of the intermediate transport member. When the imaging member rotates and is recharged with another color of toner particles, the imaging member with the negatively charged toner particles is again positioned across from the intermediate transport image where the first toner was deposited. There are, however, already negatively charged toner particles on the front side of the intermediate transport member. The potential between the negatively charged toner particles on the imaging member and the positive charge on the back side of the intermediate transport member, in addition to the negatively charged particles on the intermediate transport member, again causes breakdown of the air. Positively charged particles of air are attracted to the front side of the intermediate transport member, due to the negatively charged toner particles already positioned on the intermediate transport member, thereby neutralizing the electrical field and preventing the migration of additional toner particles of different colors. To avoid this problem, it is presently necessary to use conductive electrostatic devices to discharge the intermediate transport member.

Each of the systems discussed above attempts to improve the quality of the image being electrostatically transferred. However, each of these systems has their limitations. Transport materials comprised of rubber are not very compatible with Isopar®, a decane toner dispersant used for liquid toners. Insulative materials used for the transport member do not adequately discharge. In some cases, materials used for the surface of the intermediate transport member do not allow for the transfer and printing of a high resolution image to the copy sheet.

SUMMARY OF THE INVENTION

It is an object of this invention to create a compliant self-discharging semi-conductive conformable intermediate transport member with low surface energy that will require no electrostatic conditioning devices.

It is a further object of the invention that less ozone will be produced, and that there will be reduced or no risk of toner sign changes due to a discharge device.

A further object of the invention is to enable sequential transfer to intermediates with larger dielectric thicknesses and to eliminate the need to change electrostatic conditions on subsequent transfers.

Another object of the invention is for the compliant intermediate transport member to be relatively insensitive to surface morphology to allow for the transfer of extremely high resolution images to a wide range of substrates, thus allowing high resolution images to be transferred.

Another object of this invention is to allow for variable and larger transfer nip dwells.

Another object of this invention is to control the transfer entrance nip and the strip point.

In the invention, a toner image is transferred from an electrostatographic imaging member to an image receiving substrate. A biased transfer member in the form of a roller or a belt forms a nip with the imaging member. A compliant intermediate transport member opposite the imaging member receives a toner image from the imaging member. The intermediate transport member is preferably semiconductive, and self-discharges in less than one second if its resistivity is less than $10^{12}$ ohm-centimeters. In a preferred process for transferring to a conductive conformable intermediate, both the intermediate transport member and the biased transfer member are conductive.

DETAILED DESCRIPTION OF PREFERRED EMBODIMENTS

In the invention, a conductive intermediate transport member is preferably comprised of a material that has good dimensional stability, is conformable to the structure of an image substrate such as paper, and is self-discharging.

Figure 1:
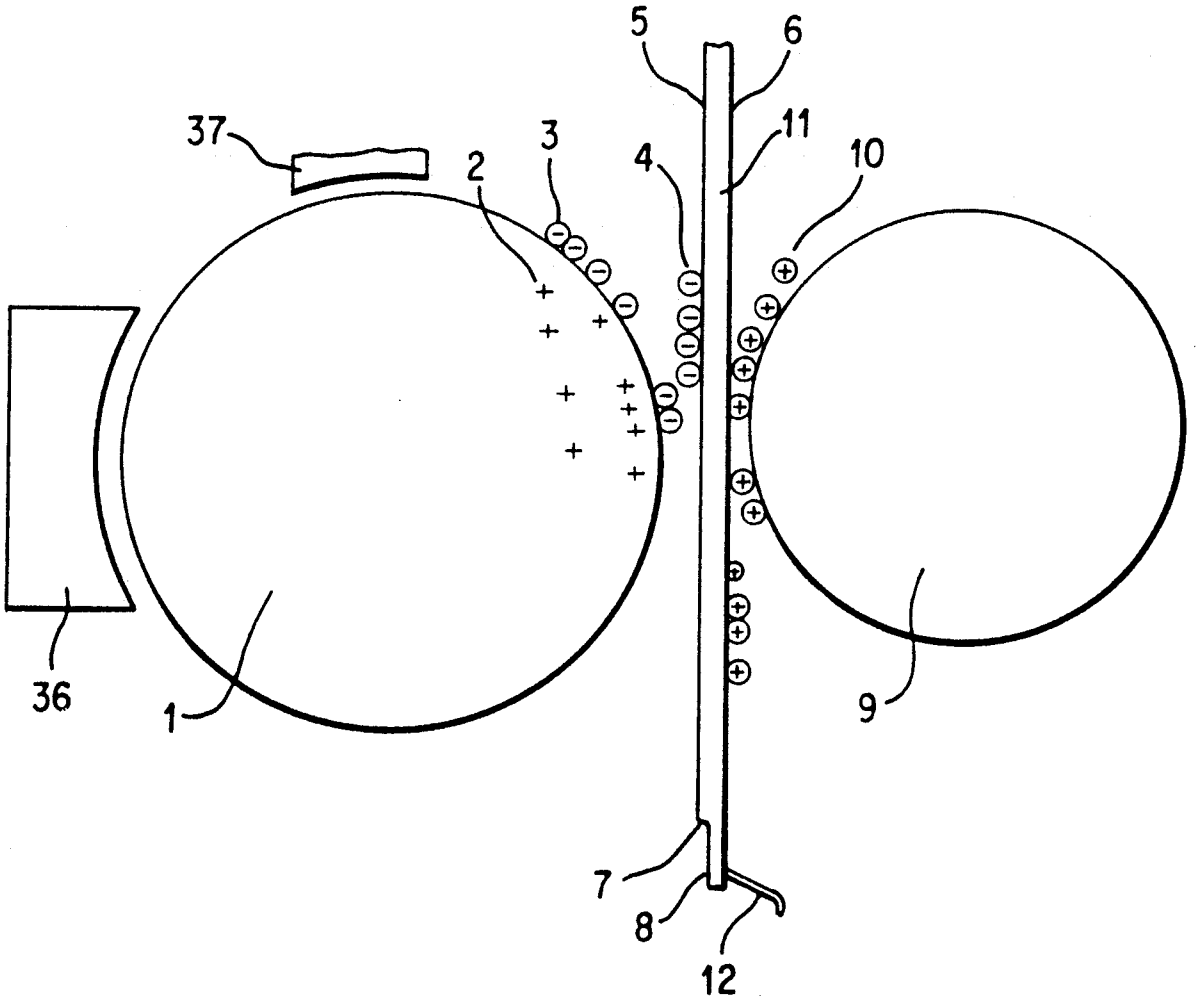
FIG. 1 is a schematic view of an image transfer system of the present invention.
Figure 2:
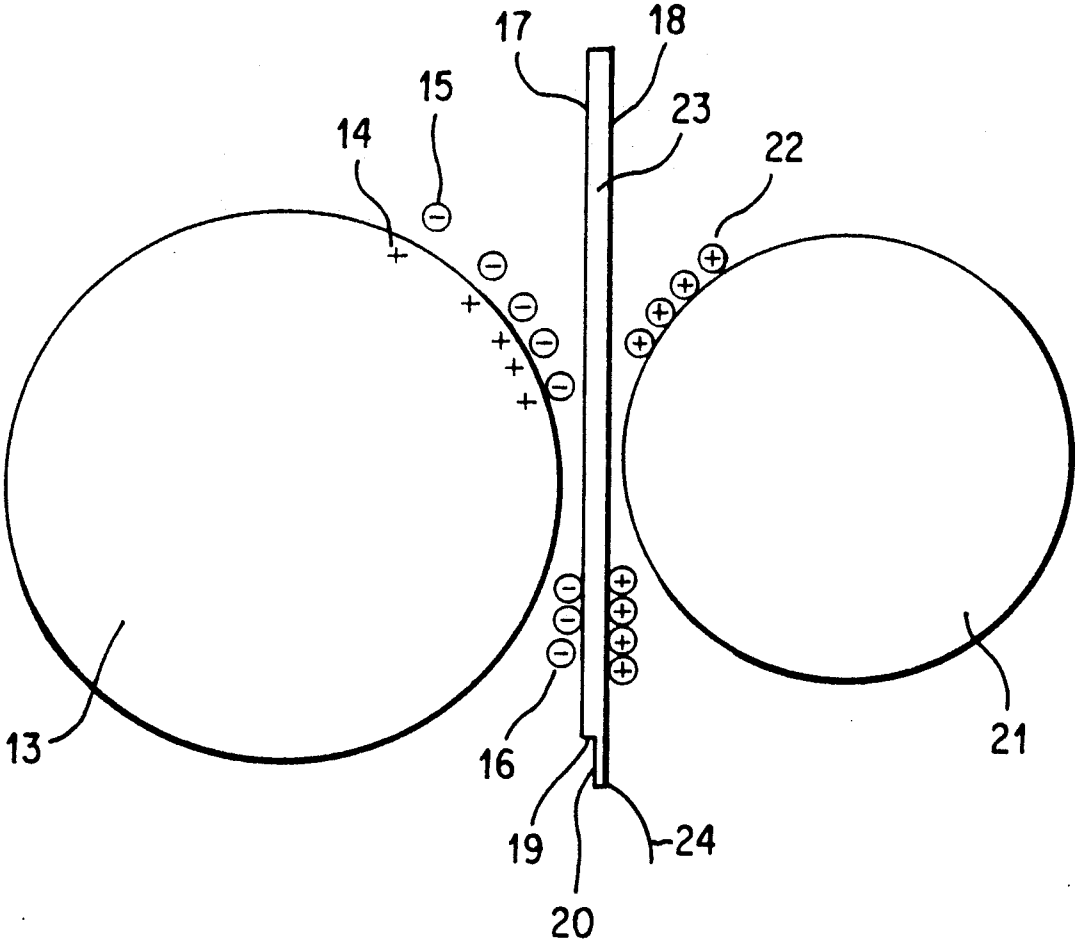
FIG. 2 is another schematic view of a image transfer system of the present invention.

As shown in FIG. 1, the conductive conformable intermediate transport member 11 is positioned between an imaging member 1 and a transfer roller 9. In FIG. 1, the imaging member is exemplified by a photoreceptor drum. However, other appropriate imaging members may include electrostatographic imaging receptors, ionographic belts and drums, electrophotographic belts, etc.

In a multiimaging system, each image being transferred is formed on the imaging drum by image forming station 36. Each of these images is then developed at developing station 37 and transferred to an intermediate transport member 11. Each of the images may be formed on the photoreceptor drum sequentially and then sequentially developed and transferred to the intermediate transport member 11, or, in an alternative method, each image may be formed on the photoreceptor drum 1, developed, and formed on the intermediate transport member 11, whereupon the imaging drum 1 will be cleaned and the next image will be formed on the imaging drum 1 for the process to begin anew.

In a preferred embodiment of the invention, the multi-image system is a color copying system. In this color copying system, each color of an image being copied is formed on the photoreceptor drum. Each of these color images is then developed and transferred to the intermediate transport member 11. As in the system described above, each of the colored images may be formed on the drum 1 sequentially and then sequentially developed and transferred to the intermediate transport member 11, or, in the alternative method, each color of an image may be formed on the photoreceptor drum 1, developed, and transferred to the intermediate transport member 11.

After latent image forming station 36 has formed a latent image on the photoreceptor drum 1 and the latent image on the photoreceptor has been developed at developing station 37, the charged toner particles 3 from the developing station 37 are attracted and held by the photoreceptor drum because the photoreceptor drum 1 possesses a charge 2 opposite to that of the toner particles 3. In FIG. 1, the toner particles 3 are negatively charged and the photoreceptor drum 1 is positively charged. These charges can be reversed, depending on the nature of the toner and the machinery being used. Similarly, while the use of a liquid developer is a preferred embodiment of the invention, this invention and system are also applicable to a dry toner system.

A biased transfer roller 9 positioned opposite the photoreceptor drum 1 has a higher voltage than the surface of the photoreceptor drum 1. The biased transfer roller 9, which contacts the back side 6 of the intermediate transport member 11, positively charges the back side 6 of the intermediate transport member 11, so that a positive charge 10 resides on the back side of the intermediate transport member 11. In an alternative embodiment of the invention, a corona or any other charging mechanism may be used to charge the back side 6 of the intermediate transport member 11.

Because the intermediate transport member 11 is positioned between the transfer roller 9 and the photoreceptor drum 1, the negatively charged toner particles 3 are attracted to the front side 5 of the intermediate transport member 11 by the negative charge 10 on the back side 6 of the intermediate transport member 11. The front side of the intermediate transport member subsequently carries negatively charged particles 4.

The intermediate transport member 11, which is semiconductive, is comprised of a material that has good dimensional stability, is conformable to the structure of the image substrate sheet, and is self-discharging. The intermediate transport member may be in the form of a sheet or belt, as it appears in the preferred embodiment, or in the form of a roller. It has a resistivity in the range of about $10^6$ ohm-centimeters to about $10^{11}$ ohm-centimeters.

Dimensional stability may be achieved by using a substrate 8 which is comprised of a thermally and electrically conductive material which has a high tensile strength for dimensional stability, compatible with any toner dispersant (e.g., Isopar), nonabsorbing, and can withstand a curing temperature of about 500° F. In a preferred embodiment, the substrate 8 is comprised of Kapton ®, a polyamine. However, the substrate 8 may be comprised of any number of materials, including stainless steel and numerous metallic alloys. The substrate 8 is preferably from about 0.001 inch to about, 0.008 inch thick. The substrate preferably has a resistivity in the range of about $10^6$ ohm-centimeters to about $10^{11}$ ohm-centimeters.

Overlaid on the substrate is a semiconductive, low surface energy, compliant elastomeric outer layer 7, preferably with a thickness of about two thousandths to about eight thousandths of an inch, a hardness of about 30 Shore Å to about 70 Shore Å,and a surface roughness having an amplitude of no more than about 2 microns and a wavelength of no less than about 10 microns. The compliant elastomeric outer layer 7 should have a surface energy of about 6 to about 30 dynes/cm. The elastomeric outer layer 7 is compatible with the toner and any toner dispersant being used. In the preferred embodiment, the outer layer 7 is comprised of Viton ® B50, a fluorosilicon elastomer, which has been spray coated onto the substrate 8. The outer layer 7 preferably has a resistivity in the range of about $10^6$ ohms-centimeter to about $10^{11}$ ohms-centimeter. This substrate and outer layer design allows for the even distribution of contact pressures to reduce image displacement by conforming to a copy sheet, resulting in improved toner transfer and fusing.

The transport member is preferably made self-discharging by having the substrate 8 and the elastomeric outer layer 7 made self-discharging by making them electrically semiconductive. The material will self-discharge in less than one second if its resistivity is less than about $10^{12}$ ohm-centimeters and more than about $10^6$ ohm-centimeters. The substrate 8 and the outer layer 7 may be made semiconductive by the addition of powdered carbon, salts, metal or metallic salts, which allow the charges on the front side 5 and back side 6 of the semiconductive intermediate transport member to bleed off.

After a breakdown of the air occurs between the imaging member and the intermediate transport sheet, positive charges from the air move to the front of the intermediate transport member 11 so that there are some positive charges residing on the front side 5 and some positive charges residing on the back side 6. The back side 6 of the intermediate transport member 11 is grounded by a ground 12 so that the charges may bleed off and dissipate. As the intermediate transport member 11 is semiconductive, the positive charges on the front side 5 will migrate to the nonimage or back side 6 of the intermediate transport member and dissipate. However, the negative charges 4 on the front side 5 of the intermediate transport member 11 balance with the positive charges 10 on the back side 6 of the intermediate transport member 11 so that only the positive charges on the front side 5 and excess positive charges on the back side 6 are dissipated. Because there is no discharging device, less ozone is produced by the copying machine.

Images can be electrostatically transferred to the intermediate transport member 11 from photoreceptors comprised of such materials as selenium. An unlimited number of transfers can be made to the intermediate transport member 11 without having to stop to discharge it. Since it is not necessary to discharge the intermediate transport member 11 with a corona device, there is no risk of changing toner sign. The same material can be used for transfixing images to paper.

In another embodiment of the invention, the imaging member or, in this case the photoreceptor drum 13, has a dielectric thickness preferably no greater than about 6 microns, with a range of about 3 to about 8 microns, and a conductive biased transfer roller 21 which has a resistivity of equal to or less than about $10^6$ ohm-centimeters. The intermediate transport member 23 is also conductive and self-discharging, and has a resistivity of less than about $10^6$ ohm-centimeters. The self-discharging conductive intermediate transport member 23 has a back side 18 which becomes positively charged by means of the charged particles 22 imparted to it from the conductive biased transfer roller 21 and a front side 17 which attracts the negatively charged toner particles 16. The positive charges 14 of the imaging member 13 retain the negatively charged toner particles 15 of the toner laden image until the charged particles are attracted to the front side 17 of the intermediate transport member 23. The imaging member, which in this embodiment is a photoreceptor drum 13, acts as a capacitor. If the dielectric thickness is large, the capacitance is small and the electrostatic field that the toner can cross is small. If, however, the dielectric thickness is small, the capacitance is large and a significant field can be formed across the image.

In this embodiment of the invention, the intermediate transport member 23 is conductive, as preferably are both its outer layer 19 and its substrate 20, both of which are constructed and have properties similar to those described in the first embodiment of the invention. The conductive intermediate transport member is self-discharging and is grounded by a ground 24. It is important that the dwell time in the nip between the photoreceptor 13 and the intermediate transport member 23 be kept small, preferably less than one second, since in a system with low resistivities, the transfer field rises rapidly after the nip is formed, then falls off as the charge across the image is transferred to the substrate via the toner conductivity.

Figure 3:
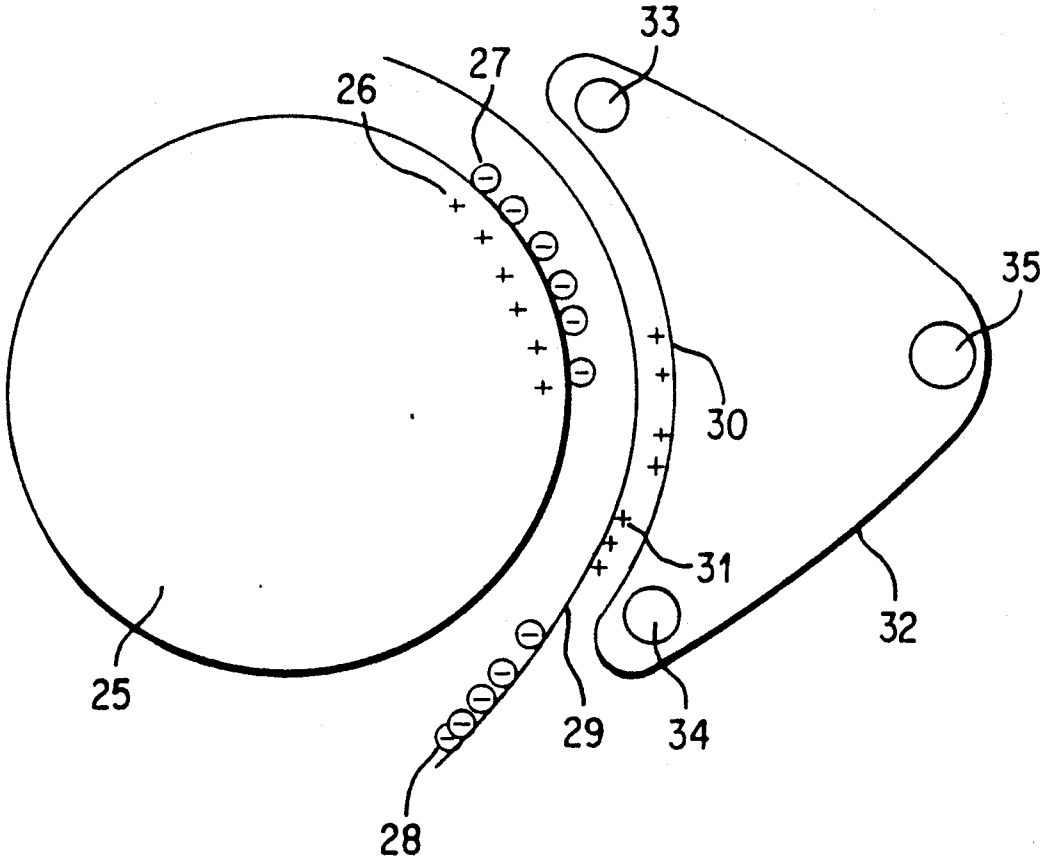
FIG. 3 is a schematic view of a preferred embodiment of the invention wherein the biased transfer member is a conductive belt.

In a preferred embodiment of the invention, the biased transfer member is in the form of a conductive transfer belt 32 as shown in FIG. 3. The biased transfer belt 32 is preferably comprised of a conductive material such as nickel formed into a belt or sheet with a rubber, synthetic rubber, or conductive copolymer material coating the conductive material. The front side 30 of the belt 32 follows the arc of the imaging member 25, creating the proper length transfer nip necessary for the intermediate transport member 29 to receive high quality electrostatic transfer. The length of the nip is dependent on the process of the imaging machine and on the particle mobility of the toner particle from the imaging receptor to the intermediate transport member.

Entrance roller 34 and exit roller 33 allow for the configuration of the arc, with a back field roller 35 allowing for the adjustment of the tension of the transfer belt 32. An optional roller (not shown) midway between entrance roller 34 and exit roller 33 positioned on the concave portion of the arc may help guide the biased transfer belt 32. As in FIG. 1, the positive charge on front side 30 of the transfer belt 32 forms a positive charge 31 on the back side of member 29 which draws the negatively charged toner 27 from the positively charged photoreceptor drum 25 (having positive charge 26) onto the intermediate transport member 29 so that the front side of intermediate transport member 29 carries negatively charged toner particles 28. The transfer belt 32 is biased just as the transfer roller is biased. This embodiment is particularly useful with a self-discharging intermediate transport member as described above. However, it is also very useful with other known transport members.

After the toner laden image has been transferred from the photoreceptor drum to the intermediate transport member, the intermediate transport member may be contacted under heat and pressure to a substrate sheet which is preferably paper. The toner laden image on the intermediate transport member melts and flows into the irregularities of the paper. Because the outer layer of the transport member has a very smooth, low surface energy, compliant surface, it readily presses the melted toner into intimate contact with the paper copy sheet. The toner flows readily into the irregularities of the paper and cools quickly. When the intermediate transport member and paper substrate separate, the toner has completely transferred to the paper, providing a sharp, high resolution image. Line widths of 10 microns have been transferred to Xerox 4024 paper using this technique. Either dry or liquid toner can be used. The image produced gives the appearance of being printed, not photocopied.

While the invention has been described with reference to the structures and embodiments disclosed herein, it is not confined to the details set forth, and this application is intended to cover such modifications or changes as may come within the purpose of the improvements and the scope of the following claims.

What is claimed is:

1. A system for transferring a toner image from an electrostatographic imaging member to an image receiving substrate, comprising:

an electrostatographic imaging member;

a compliant self-discharging semiconductive intermediate transport member for receiving a toner image from said imaging member, said semiconductive intermediate member having a resistivity in the range of about $10^6$ ohm-centimeters to about $10^{12}$ ohm-centimeters, said semiconductive intermediate member having a front side and a back side, with said front side opposing a portion of a surface of said imaging member; and an electrically biased transfer belt for charging said back side of said semiconductive intermediate member.

2. The system of claim 1, wherein said semiconductive intermediate member comprises:

a dimensionally stable substrate; and a low surface energy compliant elastomeric outer layer.

3. The system of claim 2, wherein said outer layer is semiconductive.

4. The system of claim 3, wherein said outer layer has a resistivity in the range of about $10^6$ ohm-centimeters to about $10^{12}$ ohm-centimeters.

5. The system of claim 2, wherein said substrate is semiconductive.

6. The system of claim 5, wherein said substrate has a resistivity in the range of about $10^6$ ohm-centimeters to about $10^{12}$ ohm-centimeters.

7. The system of claim 2, wherein said outer layer has a durometer from about 30 Shore Å to about 70 Shore Å.

8. The system of claim 3, wherein said outer layer has a thickness from about 0.002 inches to about 0.008 inches.

9. The system of claim 3, wherein said outer layer has a nonabsorbing surface.

10. The system of claim 3, wherein said semiconductive intermediate member comprises a belt.

11. The system of claim 3, wherein said outer layer of said intermediate member has a surface roughness having an amplitude of no more than about 2 microns and a wavelength of no less than about 10 microns.

12. A system for transferring a toner image from an electrostatographic imaging member to an image receiving intermediate transport member, comprising:

an electrostatographic imaging member;

an electrically biased transfer belt arranged adjacent said imaging member to form a nip between said biased transfer belt and said imaging member; and an intermediate transport member located in said nip between said imaging member and said biased transfer belt.

13. The system of claim 12, wherein said intermediate transport member comprises an intermediate transport belt.

14. The system of claim 12, wherein said biased transfer belt is conductive.

15. The system of claim 12, wherein said biased transfer belt is comprised of a sheet of conductive material selected from the group consisting of natural rubber and synthetic rubber.

16. The system of claim 12, wherein said biased transfer belt passes around at least two rollers which cause said belt to follow the arc of an imaging member between said roller.

17. A system for transferring a toner image from an electrostatographic imaging member to an image receiving substrate comprising:

an electrostatographic imaging member having a small dielectric thickness of about 3 to about 8 microns;

an electrically biased conductive transfer member; and a conductive self-discharging intermediate transport member for receiving a toner image from said imaging member and having a resistivity of less than about $10^6$ ohm-centimeters.

18. The system of claim 17, wherein said biased transfer member is a biased transfer roller.

19. The system of claim 17, wherein said biased transfer member is a biased transfer belt.

20. The system of claim 17, wherein said biased conductive transfer member has a resistivity of up to about $10^6$ ohm-centimeters.

21. The system of claim 17, wherein said imaging member has a dielectric thickness of about 6 microns.

22. The system of claim 17, wherein said imaging member is a photoreceptor drum.

23. The system of claim 17, wherein said conductive intermediate transport member is self-discharging.

24. The system of claim 23, wherein said conductive intermediate transport member comprises:

a dimensionally stable substrate; and a conductive, low surface energy compliant elastomeric outer layer.

25. The system of claim wherein said outer layer has a resistivity of up to about $10^6$ ohm-centimeters.

26. The system of claim 24, wherein said substrate is conductive.

27. The system of claim 24, wherein said substrate has a resistivity of up to about $10^6$ ohm-centimeters.

28. The system of claim 24, wherein said outer layer has a durometer from about b 30 Shore Å to about 70 Shore Å.

29. The system of claim 24, wherein said outer layer has a thickness from about 0.002 inches to about 0.008 inches.

30. The system of claim 24, wherein said outer layer has a nonabsorbing surface.

31. The system of claim 24, wherein said conductive intermediate member comprises a belt.

32. The system of claim 24, wherein said outer layer of said intermediate member has a surface roughness having an amplitude of no more than about 2 microns and a wavelength of no less than about 10 microns.

33. A method for transferring a toner image from an electrostatographic imaging member to an image receiving substrate, comprising:

forming an image on an electrostatographic imaging member having a dielectric thickness of about 3 to about 8 microns;

developing said image on said electrostatographic imaging member, forming a toner laden image;

electrostatically transferring said toner laden image to a conductive, self-discharging intermediate transport member, said intermediate transport member passing between said electrostatographic imaging member and a biased conductive transfer member, said intermediate transport member comprising a dimensionally stable substrate and a conductive, low surface energy compliant elastomeric outer layer; and contacting said toner laden image on said intermediate transport member to a substrate sheet, and transferring said toner laden image to said substrate sheet.

* * * * *